US012186798B2

(12) United States Patent
McCallum et al.

(10) Patent No.: US 12,186,798 B2
(45) Date of Patent: Jan. 7, 2025

(54) SENSING EVENTS IN A METAL CASTING SYSTEM

(71) Applicant: Novelis Inc., Atlanta, GA (US)

(72) Inventors: John Robert Buster McCallum, Spokane, WA (US); Phillip Wilson, Coeur d'ALene, ID (US); Larry Hudson, Pulaski, NY (US); Richard Shockley, Lake Liberty, WA (US); Todd F. Bischoff, Spokane Valley, WA (US); Adwait Thakur, Spokane Valley, WA (US)

(73) Assignee: NOVELIS INC., Atlanta, GA (US)

( * ) Notice: Subject to any disclaimer, the term of this patent is extended or adjusted under 35 U.S.C. 154(b) by 0 days.

(21) Appl. No.: 18/596,071

(22) Filed: Mar. 5, 2024

(65) Prior Publication Data

US 2024/0207924 A1 Jun. 27, 2024

Related U.S. Application Data

(63) Continuation of application No. 18/005,885, filed as application No. PCT/US2021/042955 on Jul. 23, 2021, now Pat. No. 11,951,534.

(Continued)

(51) Int. Cl.
*B22D 11/16* (2006.01)
*B22D 11/049* (2006.01)

(52) U.S. Cl.
CPC ..... *B22D 11/16* (2013.01); *B22D 11/049* (2013.01)

(58) Field of Classification Search
CPC ..... B22D 11/16; B22D 11/049; B22D 11/51
See application file for complete search history.

(56) References Cited

U.S. PATENT DOCUMENTS 4,542,781 A 9/1985 Kreyenhop
5,136,876 A 8/1992 Taylor
(Continued)

FOREIGN PATENT DOCUMENTS

JP 58205662 A 11/1983
JP 59133959 A 8/1984
(Continued)

OTHER PUBLICATIONS

CA3183893, "Office Action", Mar. 7, 2024, 4 pages.
(Continued)

*Primary Examiner* — Kevin P Kerns
*Assistant Examiner* — Steven S Ha
(74) *Attorney, Agent, or Firm* — Kilpatrick Townsend & Stockton LLP

(57) ABSTRACT

Systems and methods are disclosed for an event detection system that captures data associated with events while a DC casting system forms an ingot, determines characteristics of the events, and improves the casting system based on the events. Example systems and methods may include initiating a casting operation using one or more pieces of equipment of a casting system including a casting apparatus; capturing sensor data associated with one or more acoustic signals captured relative to the one or more pieces of equipment performing the casting operation; comparing the sensor data with a set of acoustic profiles; determining whether a particular type of event has occurred; causing an adjustment to the casting system or to the casting operation based on whether the particular type of event has occurred; and initiating a second casting operation using the adjusted casting system or casting operation.

16 Claims, 10 Drawing Sheets

Related U.S. Application Data

(60) Provisional application No. 62/705,943, filed on Jul. 23, 2020, provisional application No. 62/705,947, filed on Jul. 23, 2020.

(56) References Cited

U.S. PATENT DOCUMENTS

| | | | |
|---|---|---|---|
| 5,605,188 | A | 2/1997 | Banny et al. |
| 6,279,645 | B1 | 8/2001 | McGlade et al. |
| 11,951,534 | B2 | 4/2024 | McCallum et al. |
| 2001/0029785 | A1 | 10/2001 | Heaslip et al. |

FOREIGN PATENT DOCUMENTS

| | | | |
|---|---|---|---|
| JP | 0323045 | | 1/1991 |
| JP | 10507827 | A | 7/1998 |
| JP | 11114657 | A | 4/1999 |
| JP | 11514301 | A | 12/1999 |
| JP | 2005088065 | A | 4/2005 |
| JP | 2010012470 | A | 1/2010 |
| RU | 2703606 | C2 | 10/2019 |
| RU | 2721258 | C1 | 5/2020 |
| SU | 1585060 | A1 | 8/1990 |
| WO | 2020052849 | A1 | 3/2020 |

OTHER PUBLICATIONS

U.S. Appl. No. 18/005,885, "Corrected Notice of Allowability", Dec. 28, 2023, 2 pages.
U.S. Appl. No. 18/005,885, "Notice of Allowance", Dec. 13, 2023, 12 pages.
EP21755269.4, "Office Action", Dec. 15, 2023, 6 pages.
JP2023-503461, "Office Action", Jan. 9, 2024, 10 pages.
KR10-2022-7042255, "Office Action", Jan. 23, 2024, 5 pages.
PCT/US2021/042955, "International Preliminary Report on Patentability", Feb. 2, 2023, 9 pages.
PCT/US2021/042955, "International Search Report and Written Opinion", Oct. 5, 2021, 12 pages.
RU2022130916, "Notice of Decision to Grant", Jan. 11, 2024, 19 pages.
RU2022130916, "Office Action", May 29, 2023, 13 pages.
EP21755269.4, "Office Action", Apr. 25, 2024, 5 pages.

SENSING EVENTS IN A METAL CASTING SYSTEM

CROSS-REFERENCE TO RELATED APPLICATION

This application is a continuation of U.S. National Phase application Ser. No. 18/005,885, filed Jan. 18, 2023, and titled "SENSING EVENTS IN A METAL CASTING SYSTEM", which claims priority to International Application No. PCT/US2021/042955, filed Jul. 23, 2021, and titled "SENSING EVENTS IN A METAL CASTING SYSTEM", which claims the benefit of and priority to U.S. Provisional Application No. 62/705,943, filed on Jul. 23, 2020, and titled "SENSING EVENTS IN A METAL CASTING SYSTEM" and U.S. Provisional Application No. 62/705,947, filed on Jul. 23, 2020, and titled "MONITORING CASTING ENVIRONMENT," the contents of both of which are herein incorporated by reference in their entireties for all purposes.

FIELD OF THE INVENTION

This application relates to sensing events in a casting system. More specifically, systems and methods are disclosed for an event detection system that captures data associated with events while a casting system forms an ingot, determines characteristics of the events, and improves the casting system and/or the casting operation based on the events.

BACKGROUND

Molten metal can be formed in a mold to create a metal ingot. A common method of producing these metal ingots is direct chill (DC) casting. In direct chill casting, molten metal is poured into a shallow, water-cooled mold. The bottom of the mold is a bottom block mounted on a hydraulic table to form a false bottom. As metal fills the mold, the outer portion of the ingot is cooled and solidifies to form a shell. As the bottom block is lowered, more metal is fed into the top of the mold and the lower portion of the ingot is exposed to the cooling liquid.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

An example embodiment of the present technology may include an apparatus for detecting events during a casting operation. The apparatus may comprise a mold; a conduit configured to deliver molten metal to the mold for casting the molten metal into an ingot; an acoustic sensor configured to sense acoustic signals during the casting operation, wherein the sensor (e.g., acoustic sensor) captures initial sensor data associated with acoustic signals from multiple casting operations over an initial period of time, and wherein the sensor (e.g., acoustic sensor) captures sensor data associated with the casting operation; and a controller comprising a processor configured to execute instructions stored on a non-transitory computer-readable medium in a memory. The controller may cause the processor to perform operations including, for example, generating, using the initial acoustic signals, a set of acoustic profiles, each acoustic profile of the set of acoustic profiles being associated with a type of event associated with the multiple casting operations over the initial period of time; comparing the sensor data with the set of acoustic profiles; determining, based on the comparison, whether a particular type of event has occurred; causing an adjustment to the casting apparatus or to the casting operation based on whether the particular type of event has occurred; and initiating a second casting operation using the adjusted casting apparatus or casting operation.

Additional operations may further include updating the set of acoustic profiles using the sensor data and the determination of whether a particular type of event has occurred. In additional aspects, comparing the sensor data with the set of acoustic profiles includes comparing characteristics of the acoustic signals captured relative to the casting operation to characteristics of acoustic signals captured during previous casting operations. In additional aspects, the characteristics of the acoustic signals include one or more of frequency, pitch, loudness, or tone. In additional aspects, an acoustic profile of the set of acoustic profiles includes a machine learning algorithm generated using data associated with multiple instances of a particular event associated with one or more casting systems. In additional aspects, determining whether a particular type of event has occurred includes determining a recommendation regarding whether the particular type of event has occurred and a likelihood that the particular type of event has occurred based on the sensor data. In additional aspects, causing an adjustment to the casting apparatus or to the casting operation includes shutting off the casting apparatus. In additional aspects, causing an adjustment to the casting apparatus or to the casting operation includes generating a modified recipe for the casting operation. In additional aspects, the particular type of event includes one or more of a bleed out, a bleed over, a butt bounce, butt curl, or a water cooling operation. The apparatus may further include a melting furnace, a holding furnace, a degasser, and a filter.

Another example embodiment may include a method of detecting events in casting of metal. The method may comprise, for example, initiating a casting operation using one or more pieces of equipment of a casting system including a casting apparatus, the casting operation comprising one or more actions that cause or facilitate casting of an ingot within a mold in the casting apparatus; capturing, using an acoustic sensor, sensor data associated with one or more acoustic signals captured relative to the one or more pieces of equipment performing the casting operation; comparing the sensor data with a set of acoustic profiles, each acoustic profile of the set of acoustic profiles being associated with a type of event associated with the casting operation; determining, based on the comparison, whether a particular type of event has occurred; causing an adjustment to the casting system or to the casting operation based on whether the particular type of event has occurred; and initiating a second casting operation using the adjusted casting system or casting operation.

Additional aspects may further comprise capturing, using an initial acoustic sensor, sensor data from multiple casting operations using one or more initial casting apparatuses over a period of time; and generating, using the sensor data, the set of acoustic profiles.

In additional aspects, the one or more initial casting apparatuses includes the casting apparatus. Additional aspects may further include updating the set of acoustic profiles using the sensor data and the determination of whether a particular type of event has occurred. In additional aspects, comparing the sensor data with the set of acoustic profiles includes comparing characteristics of the acoustic signals captured relative to the one or more pieces of equipment performing the casting operation to characteristics of acoustic signals captured during previous casting operations. In additional aspects, the characteristics of the acoustic signals include one or more of frequency, pitch, loudness, or tone. In additional aspects, an acoustic profile of the set of acoustic profiles includes a machine learning algorithm generated using data associated with multiple instances of a particular event associated with one or more casting systems. In additional aspects, determining whether a particular type of event has occurred includes determining a recommendation regarding whether the particular type of event has occurred and a likelihood that the particular type of event has occurred based on the sensor data. In additional aspects, causing an adjustment to the casting system or to the casting operation includes shutting off the casting system. In additional aspects, causing an adjustment to the casting system or to the casting operation includes generating a modified recipe for the casting operation. In additional aspects, the particular type of event includes one or more of a bleed out, a bleed over, a butt bounce, butt curl, or a water cooling operation. In additional aspects, the one or more pieces of equipment include a melting furnace, a holding furnace, a degasser, and a filter.

Another example embodiment may include a system for detecting events during a casting operation. The system may comprise, for example, one or more pieces of equipment of a casting system including a casting apparatus, wherein the casting operation comprises one or more actions that cause or facilitate casting of an ingot within a mold in the casting apparatus; a sensor configured to sense acoustic signals from the casting operation, wherein the sensor captures sensor data associated with the casting operation; and a controller comprising a processor configured to execute instructions stored on a non-transitory computer-readable medium in a memory. The controller may cause the processor to perform operations including: comparing the sensor data with the set of acoustic profiles; determining, based on the comparison, whether a particular type of event has occurred; causing an adjustment to the casting system or to the casting operation based on whether the particular type of event has occurred; and initiating a second casting operation using the adjusted casting system or casting operation.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

A further understanding of the nature and advantages of various embodiments may be realized by reference to the following figures. The features and components of the figures are illustrated to emphasize the general principles of the present disclosure. In the appended figures, similar components or features may have the same reference label. Further, various components of the same type may be distinguished by following the reference label with a dash and a second label that distinguishes among the similar components. If only the first reference label is used in the specification, the description is applicable to any one of the similar components having the same first reference label irrespective of the second reference label.

DETAILED DESCRIPTION

The subject matter of examples of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
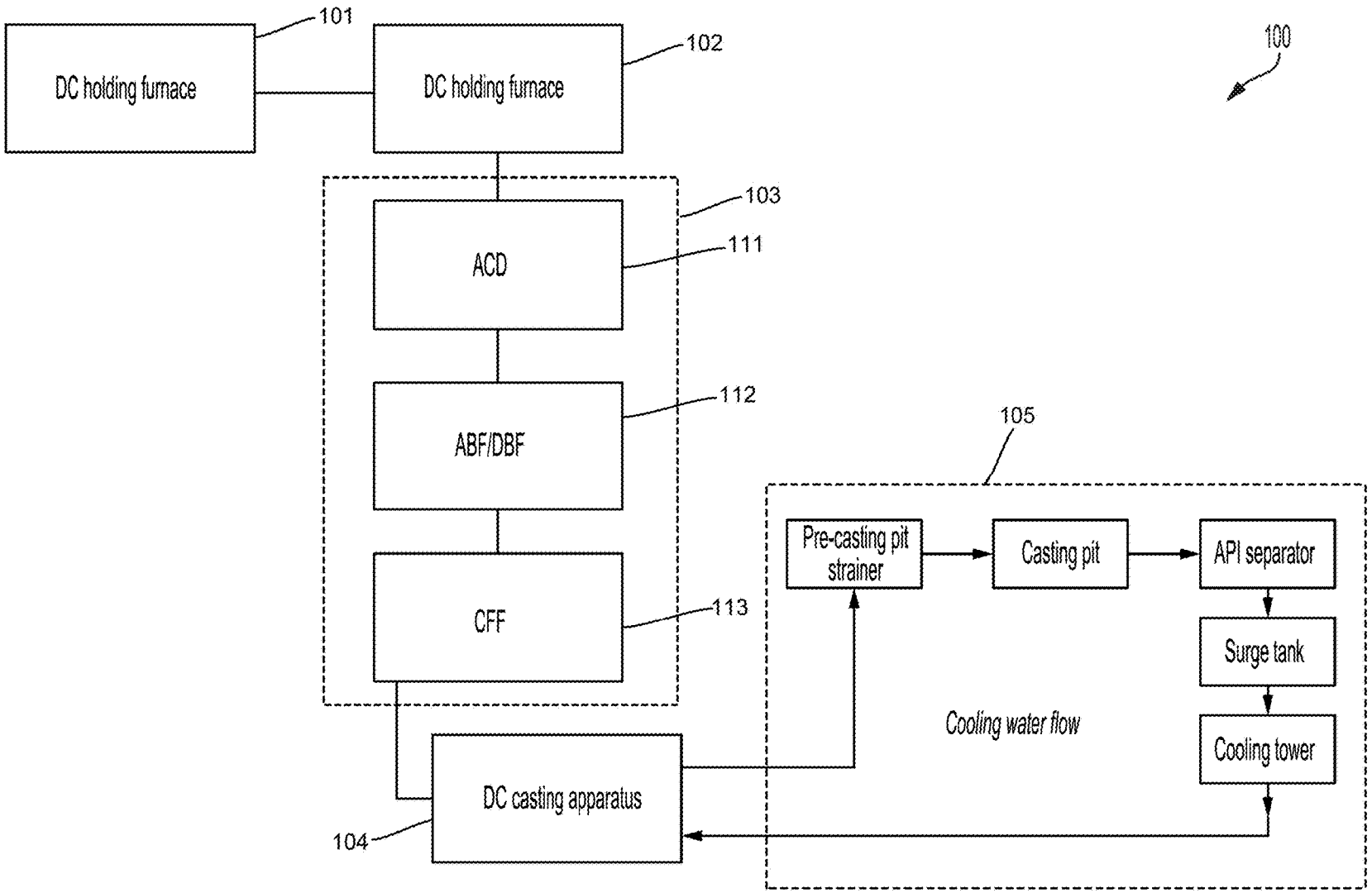
FIG. 1 is a block flow diagram illustrating an example direct chill casting system and process, according to embodiments of the present technology.

FIG. 1 is a block flow diagram 100 illustrating an example casting system and process, according to embodiments of the present technology. Diagram 100, and therefore the direct chill casting system, may include one or more furnaces (e.g., melting furnace, holding furnace, etc.), one or more (or zero) treating devices (e.g., degassers, filters), a DC casting apparatus, and/or a cooling water flow system. These devices may each perform a portion of a process to cast molten metal into a metal ingot, among other processes. Even though certain devices herein may be referred to as a direct chill ("DC") casting apparatus, devices suitable for any other casting method may be used such as, a semi-continuous caster, a continuous caster (including, for example, by use of a twin belt caster, a twin roll caster, a twin block caster, or any other continuous caster), an electromagnetic caster, a hot top caster, or any other casting device.

Solid metals may be melted into molten metal in metal melting furnaces, such as melting furnace 101. Although only one melting furnace is shown in FIG. 1, two or more melting furnaces may also be used as part of a similar DC casting system. The melting furnace (e.g., direct charge reverberatory furnace) may heat the contents of the furnace using radiation, direct flame, and/or other heating elements. For example, scrap or other aluminum may be melted in the melting furnace to generate molten metal. From melting furnace 101, the molten metal may be delivered to a holding furnace, such as DC holding furnace 102. DC holding furnace 102 may store quantities of molten metal previously melted by melting furnace 101. Molten metal may also be treated in a variety of different ways while in either a melting or a holding furnace. For example, certain products may be injected into the molten metal to change the chemistry of the molten metal before the molten metal is cast or otherwise used during later stages of the casting process.

From the DC holding furnace 102, the molten metal may be delivered to zero, one, or more than one treating devices 103. For example, treating devices 103 may include a degasser, filter, or other devices. More specifically, the molten metal may be delivered to an Alcan Compact Degasser (ACD) 111, an Alcan Bed Filter/Deep Bed Filter (ABF/DBF) 112, and/or a Ceramic Foam Filter (CFF) 113. ACD, ABF/DBF, and CFF each treat the molten metal and in turn remove different kinds of particles from the molten metal. For example, an ACD removes hydroven from the molten metal. In another example, an ABF/DBF removes inclusions from the molten metal. In another example, a CFF also removes inclusions from the molten metal, but may not perform as well as an ABF/DBF.

After the molten metal has been optionally passed through one or more treating devices 103, the treated molten metal may be delivered to a DC casting apparatus 104. DC casting apparatus 104 may be similar to the upright DC casting apparatus 304 shown in FIG. 3, or may be a different casting apparatus. DC casting apparatus 104 may be configured to perform a casting operation to cast ingots from the molten metal. As part of the process of forming an ingot during a casting operation, the DC casting apparatus 104 may work with a cooling water flow system 105. When molten metal is transferred from one or more furnaces to DC casting apparatus 104, the molten metal may be at extremely high temperatures. Furthermore, in order to cast molten metal into a solid metal ingot, the molten metal must be turned from a liquid into a solid, which requires cooling. Therefore, cold liquid (e.g., water) may be used to lower the temperature of the metal during the process of converting the molten metal into a solid ingot.

After liquid is cooled using the cooling water flow system 105, the liquid is fed to the DC casting apparatus 104 where it may be used as part of the DC casting process. For example, the liquid may be fed into one or more sets of jets that spray the forming ingot to cool the ingot. Cooling water flow system 105 may include one or more additional components as part of the system. For example, before liquid is sprayed onto the forming ingot, the liquid may be treated by other devices to prepare the water for the hot ingot or after it is sprayed into the casting pit. For example, the liquid may be fed into a pre-casting pit strainer before being sprayed onto the ingot. In another example, the liquid may be fed into an American Petroleum Institute (API) separator, a surge tank, and/or a cooling tower after being sprayed onto the ingot in the casting pit and before the liquid can be fed back to the DC casting apparatus 104. Cooling water flow system 105 may be considered to be part of the DC casting system, and/or specifically as part of the DC casting apparatus 104, or it may be considered to be a separate system.

Figure 2:
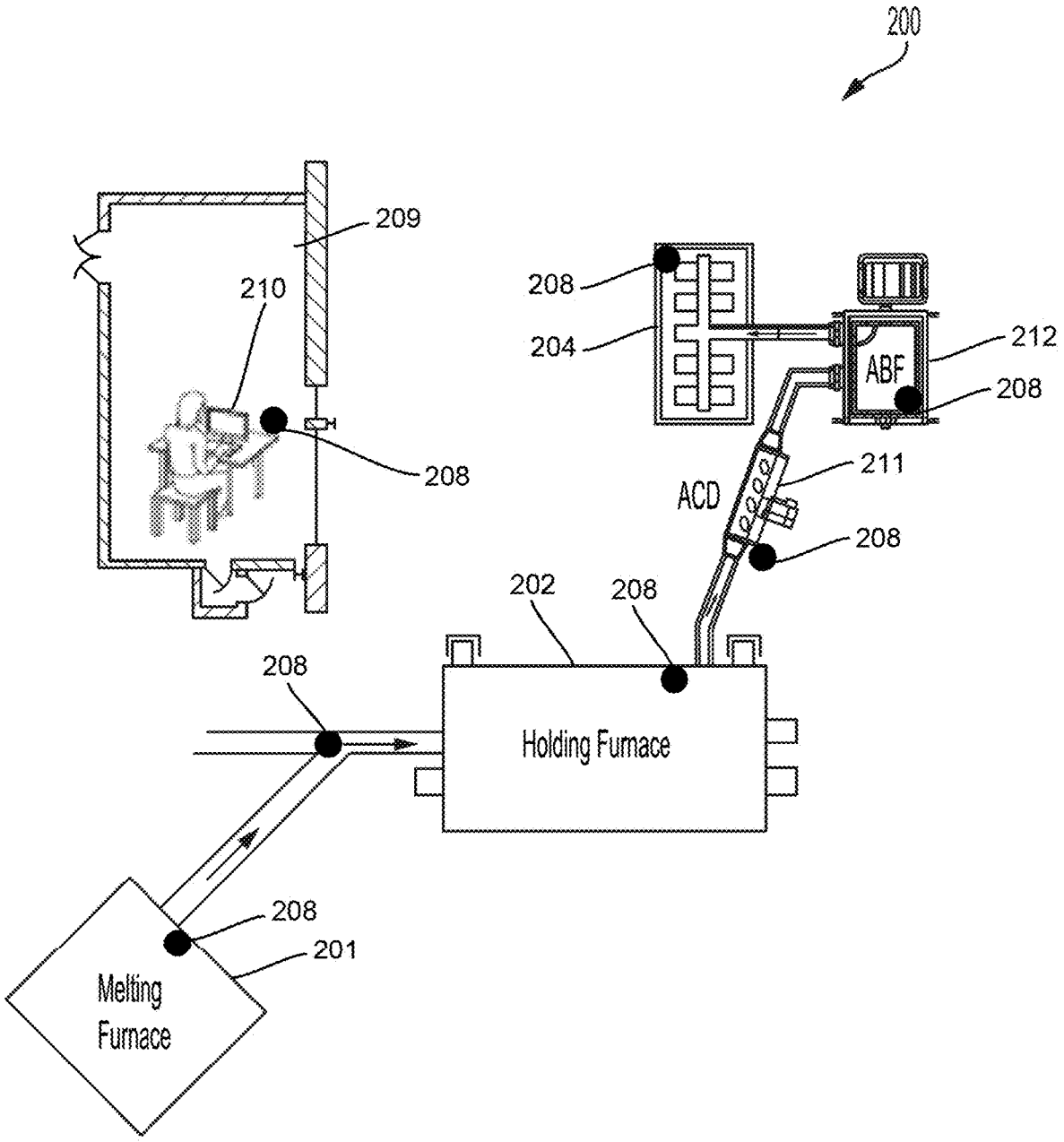
FIG. 2 is an example diagram of a DC casting system with data sensors, according to example embodiments of the present technology.

FIG. 2 is an example diagram of a DC casting system 200 with data sensors, according to example embodiments of the present technology. DC casting system 200 may include, for example, a melting furnace 201, a holding furnace 202, an ACD 211, an ABF/DBF 212, and a DC casting apparatus 204, among other systems. DC casting system 200 may also be connected to a DC casting control device 210, which may control, either manually (e.g., by a user) or automatically or some of each, the DC casting system 200. For example, casting control device 210 may help control various characteristics of each individual device within the DC casting system 200 or of how the different devices in the DC casting system work together to complete DC casting operations. For example, the casting control device 210 may control temperatures of one or more furnaces in the DC casting system 200, how fast or how often molten metal is delivered to the DC casting apparatus 204, and/or characteristics of the DC casting process itself, among other possibilities.

DC casting system 200 may also include one or more sensors 208. Sensors 208 may be physically or electronically connected to any of the devices within the DC casting system 200. For example, one or more sensors 208 may be coupled or otherwise physically connected to melting furnace 201, to holding furnace 202, to DC casting apparatus 204, or to any other device within the DC casting system 200. Sensors 208 may capture data associated with the DC casting system 200 and/or a DC casting process, such as during casting of an ingot. For example, sensors 208 may include one or more microphones to capture infrasound and/or ultrasound data from different portions of the DC casting process in the DC casting system 200. Sensors 208 may capture the infrasounds and/or ultrasounds themselves, or may capture characteristics or other data associated with those sounds. Whatever data is captured by sensors 208 may be recorded or otherwise captured on a storage medium and saved to local or external memory on one or more devices inside or outside of DC casting system 200. For example, data captured at sensors 208 may be stored at casting control device 210. Casting control device 210 or another device that receives data captured by sensors 208 may be configured to process that data to make determinations, calculations, or other decisions based on the received data. For example, if sensors 208 capture data associated with an event that took place during a casting operation by the DC casting system, casting control device 210 or another device may be configured to determine that the event took place based on the captured data and take action based on the data. For example, casting control device 210 or another device may be configured to shut off the DC casting system 200 or one or more individual components of the system, or transmit command signals or other notifications to one or more other devices, to minimize risk or damage associated with the event.

Sensors 208 (and other sensors described herein) may include a variety of different types of sensors. For example, a sensor may include a microphone or other device to capture sounds. The microphone may be directional, bi-directional, omnidirectional, dynamic, condenser, or other types. Other sensors may include an oscilloscope, accelerometer, vibration sensor, or other types of sensors. Any type of sensor that is also capable of being in a location where it can capture sounds, vibrations, or other data from the casting system may be used.

Even though sensors 208 in FIG. 2 are shown to be placed in certain locations on certain devices within the DC casting system 200, a person of ordinary skill in the art would understand that sensors 208 may be coupled to or otherwise exist in the DC casting system 200 in different locations. Furthermore, even though a certain number of sensors 208 are shown in FIG. 2, fewer or more sensors 208 may be included in the system.

Figure 3:
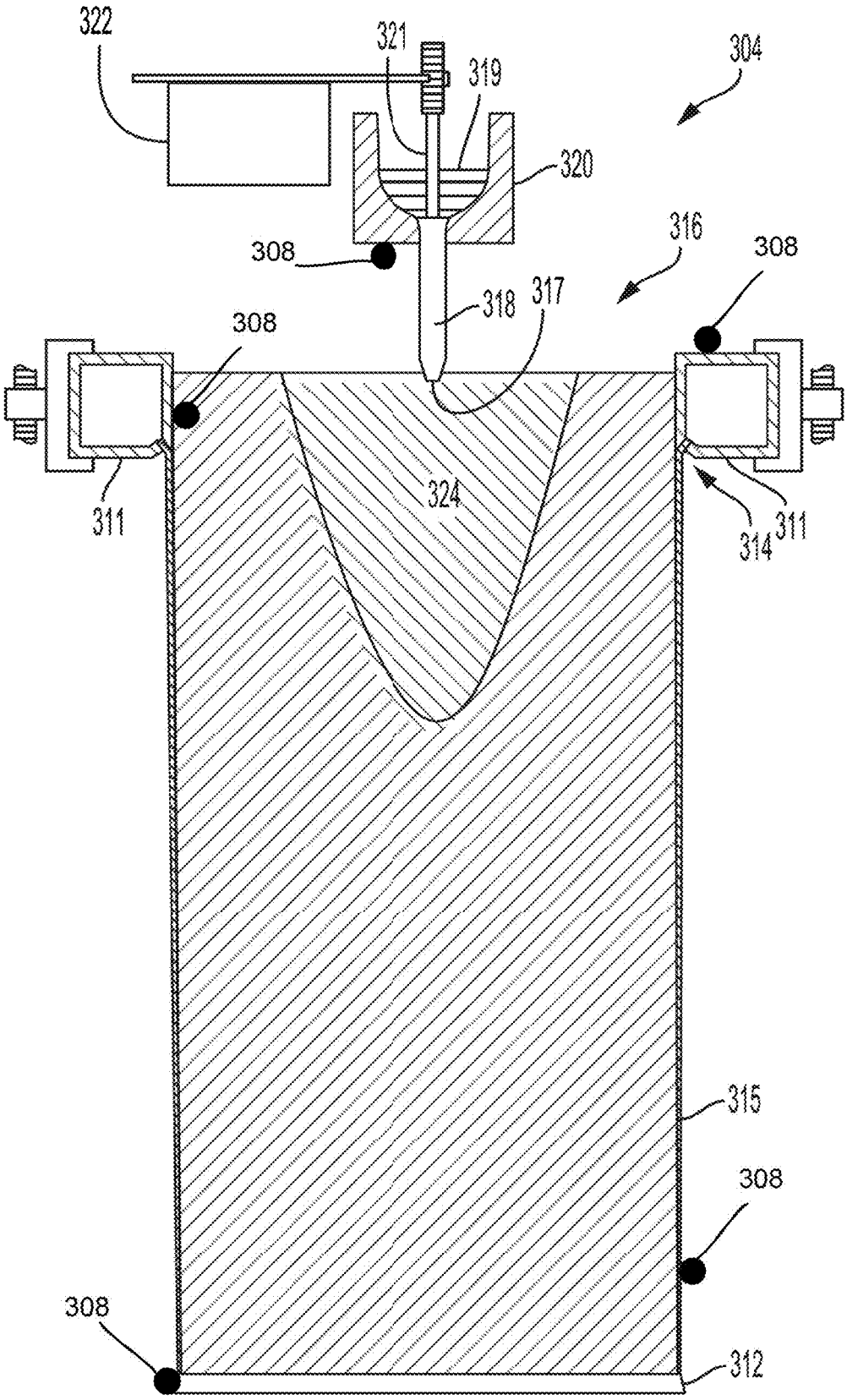
FIG. 3 is a schematic representation of a direct chill casting apparatus as it appears toward the end of a casting operation, according to various examples.

FIG. 3 is a simplified schematic vertical cross-section of an upright DC casting apparatus 304, illustrated toward the end of a casting operation. As noted above, in some cases, the disclosed processes and systems can be used with a continuous casting process. The apparatus may include a mold 311 (e.g., a DC casting mold) and a bottom block 312 that moves gradually vertically downwardly by suitable support means (not shown) during the casting operation from an upper position initially closing and sealing a lower end 314 of the mold 311 to a lower position (as shown) supporting a cast ingot 315. Mold 311 may be of rectangular annular form (shown in FIG. 3 in cross-sectional view) or circular or other shape. An ingot may be produced in the casting operation by introducing molten metal into an upper end 316 of the mold through a vertical hollow spout 318 or similar metal feed mechanism while the bottom block 312 is lowered as the ingot forms and solidifies. Molten metal 319 is supplied to the spout 318 from a metal melting furnace (not shown in FIG. 3, but which may be similar to melting furnace 101 in FIG. 1 or 201 in FIG. 2) via a launder 320 or other device forming a horizontal channel above the mold 311.

The spout 318 encircles a lower end of a control pin 321 that regulates and can terminate the flow of molten metal through the spout. In one example, a plug such as a ceramic plug forming a distal end of the control pin 321 may be received within an interior channel of the spout 318. The channel may be tapered such that when the control pin 321 is raised, the area between the plug and the open end of the spout 318 increases, thus allowing molten metal to flow around the plug and out the lower tip 317 of the spout 318. Flow and rate of flow of molten metal may be controlled precisely by appropriately raising or lowering the control pin 321. The raising or lowering of control pin 321 may be controlled by casting control device 210 (see FIG. 2), but other desirable devices, structures or mechanisms may be used for control of flow of molten metal into the mold 311. For example, DC casting apparatus 304 may optionally include a pin control device 322, which may include one or more mechanisms that contribute to the control of the control pin 321 and whether, when, or how much control pin 321 is open or closed. Pin control device 322 may be affected by additional sensors (not shown) other than sensors 308, such as a metal level sensor, which may determine the level of the molten metal in the pool 324 of the mold 311. The additional sensor(s) may also be used in a determination of whether there exists an error or other event that warrants action to terminate a casting operation or other action. Pin control device 322 may also include other mechanisms, such as a controller, an actuator, or other mechanisms. The controller may be a proportional-integral-derivative (PID) controller, which may be a conventional PID controller, or a PID controller that is implemented as desired digitally and/or programmatically.

For convenience, the terms "conduit" or "control pin" that control the position of the control pin 321 relative to the spout 318 may be utilized in this document to refer to any mechanism or structure that is capable of regulating flow or flow rate of molten metal into the mold 311 by virtue of command signals from a controller and are not limited to a pin/control pin. A pin control device 322 (e.g., control pin positioner) may also be provided to regulate molten metal flow or flow rate into a mold. Command signals may also be provided to an actuator of whatever type to control flow or flow rate of molten metal into the mold in whatever manner and using whatever device, structure or mechanism. At the completion of casting, or when an event is detected that causes the system or a user of the system to initiate termination or a temporary stop of the casting operation, the control pin 321 may be moved to a lower position where it may block the spout 318 and completely prevent molten metal from passing through the spout 318, thereby terminating the molten metal flow into pool 324 of the mold 311. When so positioned, the bottom block 312 may no longer descend, or descend further only by a small amount, and the newly-cast ingot 315 may remain in place supported by the bottom block 312 with its upper end still in the mold 311. The launder 320 may be raised at this time to withdraw the spout 318 from the head of the ingot 315.

As noted with respect to FIG. 2, the DC casting apparatus may include one or more sensors. Referring to FIG. 3, DC casting apparatus 304 may also include one or more sensors 308. Sensors 308 may capture data (i.e., sensor data) associated with the DC casting apparatus 304, such as during a casting process of an ingot. For example, sensors 308 may be or include one or more microphones to capture infrasound and/or ultrasound data from the DC casting process. Sensors 308 may capture the infrasounds and/or ultrasounds themselves, or may capture characteristics or other data associated with those sounds. Other types of sensors may also be used to capture data, such as a video camera to capture video data, a still camera to capture photograph data, among others. As explained above, whatever data is captured by sensors 308 may be recorded or otherwise captured on a storage medium and saved to local or external memory on one or more devices external to the DC casting apparatus 304. For example, data captured at sensors 308 may be transmitted to and stored at casting control device 210 shown in FIG. 2. Casting control device 210 or another device that receives data captured by sensors 208 may be configured to process that data to make determinations, calculations, or other decisions based on the received data. For example, if sensors 308 capture data associated with an event that took place during a casting operation by the DC casting system, casting control device 210 or another device may be configured to determine that the event took place based on the captured data and take action based on the data. For example, casting control device 210 or another device may be configured to shut off the DC casting apparatus 304 and/or one or more other components of the system, or transmit command signals or other notifications to one or more other devices, to minimize risk or damage associated with the event. In one example, pin control device 322 may lower the control pin 321 to stop the flow of molten metal into launder 320. In other words, data collected by sensors 308 may be used to control the control pin 321 relative to spout 318.

Sensors 308 may include one or more sensors coupled to different portions of the DC casting apparatus 304 to detect sounds coming from different portions of the DC casting apparatus 304. For example, a sensor may be located on or near the bottom block 312 for detecting events occurring near the bottom block. In another example, a sensor may be located on or near one near the mold walls for detecting events occurring near the mold wall. In another example, a sensor may be located on or near the top of the mold for detecting events at or near the top portion of the mold. In another example, a sensor may be located on or near the spout for detecting events at or near the spout, among other sensors. One or more sensors may be located in any other portion of or near the DC casting apparatus 304. Certain specific types of events that these sensors 308 may detect will be explained in further detail below.

Even though sensors 308 are shown to be placed in certain locations on the DC casting apparatus 304, sensors 308 may be coupled to or otherwise exist in the DC casting apparatus 304 in different locations. Different types of sensors or different protective material for the sensors may be necessary depending on the location of the sensors. For example, if a sensor is located within, on, or near mold 311, a sensor that may not be affected by extreme heat or additional material to protect the sensor from extreme heat may be necessary. Furthermore, even though a certain number of sensors 308 are shown in FIG. 3, fewer or more sensors 308 may be included in the system.

Figure 4:
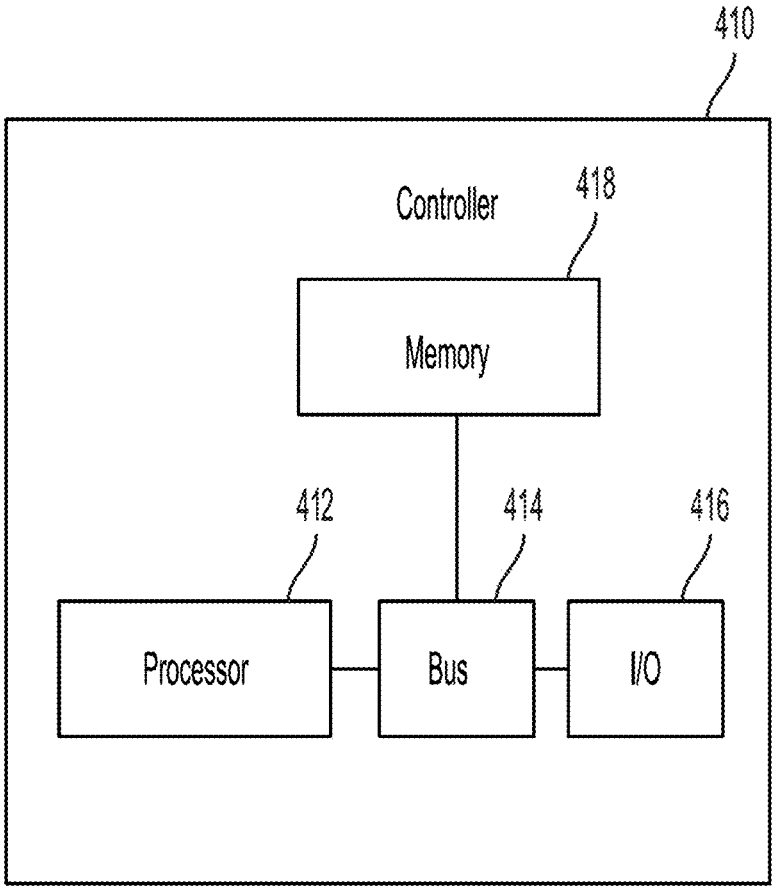
FIG. 4 is a schematic representation of a digitally and programmably implemented controller according to various examples.

FIG. 4 is an example of a controller 410 that is implemented digitally and programmatically in connection with certain examples (e.g., including equipment such as shown in FIGS. 1-3) to carry out processes of such examples. For example, controller 410 may be or may not be implemented into a processing device such as the casting control device 210 shown in FIG. 2. The controller 410 may include a processor 412 that can execute code stored on a tangible computer-readable medium in a memory 418 (or elsewhere such as portable media, on a server or in the cloud among other media) to cause the controller 410 to receive and process data and to perform actions and/or control components of equipment such as shown in FIGS. 1-3. The controller 410 may be any device that can process data and execute code that is a set of instructions to perform actions such as to control industrial equipment. As non-limiting examples, the controller 410 can take the form of a digitally and programmably implemented PID controller, a programmable logic controller, a microprocessor, a server, a desktop or laptop personal computer, a handheld computing device, and a mobile device.

Examples of the processor 412 include any desired processing circuitry, an application-specific integrated circuit (ASIC), programmable logic, a state machine, or other suitable circuitry. The processor 412 may include one processor or any other number of processors. The processor 412 can access code stored in the memory 418 via a bus 414. The memory 418 may be any non-transitory computer-readable medium configured for tangibly embodying code and can include electronic, magnetic, or optical devices. Examples of the memory 418 include random access memory (RAM), read-only memory (ROM), flash memory, a floppy disk, compact disc, digital video device, magnetic disk, an ASIC, a configured processor, or other storage device.

Instructions can be stored in the memory 418 or in the processor 412 as executable code. The instructions can include processor-specific instructions generated by a compiler and/or an interpreter from code written in any suitable computer-programming language. The instructions can take the form of an application that includes a series of setpoints, parameters for the casting process, and programmed steps which, when executed by the processor 412, allow the controller 410 to control any number of operations. The operations may include, for example, transmitting of power to the casting system, receiving of power by the casting system, flow of metal into a mold, flow rate of metal into a mold, speed of movement of the bottom block, portions of the cooling water flow system such as controlling one or more sets of jets, and other operations. Casting-related parameters may be entered into the controller 410 to control portions of the apparatus shown in FIG. 3 for controlling these various operations.

The controller 410 shown in FIG. 4 includes an input/output (I/O) interface 416 through which the controller 410 can communicate with devices and systems external to the controller 410, including components such as the sensors 208 or 308 and/or other mold apparatus components. The I/O interface 416 can also receive input data from other external sources. Such sources can include control panels, other human/machine interfaces, computers, servers or other equipment that can, for example, send instructions and parameters to the controller 410 to control its performance and operation; store and facilitate programming of applications that allow the controller 410 to execute instructions in those applications to control certain aspects of the casting system such as in connection with the processes of certain examples disclosed herein; and other sources of data necessary or useful for the controller 410 in carrying out its functions to control operation of the mold, such as mold 311 of FIG. 3, or the rest of the casting process. Such data can be communicated to the I/O interface 416 via a network, hardwire, wirelessly, via bus, or as otherwise desired. Controlling operation of the mold may include actually controlling operation of the mold itself (e.g., technologies to adjust the mold, such as its shape or size), or controlling how other devices and/or substances interact with the mold. For example, the flow of water to the mold may be adjusted, split jets within the mold may be enabled/disabled, the metal put into the mold may be adjusted, the speed which the metal is removed from the mold may be adjusted, etc.

As noted, I/O interface 416 may communicatively connect controller 410 to other devices and/or systems. For example, I/O interface 416 may connect controller 410 to certain components of a DC casting apparatus, such as DC casting apparatus 304. For example, I/O interface 416 may communicatively connect controller 410 to sensors 308 so that controller 410 may collect data captured by sensors 308. In another example, I/O interface 416 may communicatively connect controller 410 directly to other components of the DC casting system so that controller 410 may control (e.g., turn off, adjust, etc.) those components if a detected event occurs. For example, I/O interface 416 may communicatively connect controller 410 to the control pin 321, a bottom block actuator (which may, for example, control when the bottom block moves and at what speed), liquid coolant jets, and/or other components. More specifically, controller 410 may cause control pin 321 to rise or drop a certain amount to stop, start, slow or speed up the flow of molten metal based on the data received that may be associated with an event. In another example, controller 410 may cause a bottom block 312 (e.g., via a bottom block actuator) to start or stop moving or to rise or drop slower or faster based on the characteristics of the casting operation (e.g., as defined by a casting algorithm or recipe associated with the casting operation). A "recipe" of a casting operation may include a variety of predetermined characteristics and/or steps in a process that affects the casting operation. For example, the characteristics may include amounts, time periods, specific oxides, or other characteristics associated with a casting operation. In another example, controller 410 may cause water to flow slower or faster from water jets so that the forming ingot cools less or more rapidly, or to start or stop the flow of water from water jets.

I/O interface 416 may also be communicatively connected to a signal generator and/or signal receiver. Instead of capturing sounds generated by the casting system and/or casting operation, a user may generate a signal within the casting system so as to allow the user to measure certain characteristics of the casting system, the casting process, a partially or fully formed ingot, or other components. For example, a signal generator may be used to initiate a control signal through an ingot, and a signal receiver may be used to receive the generated signal once it has passed through the ingot. The self-initiated control signal may include, for example, a shockwave, an ultrasound pulse, or the like. The signal receiver, or another associated device, may be configured to analyze the received signal to determine characteristics of the ingot. For example, the received signal may be compared to the generated signal to determine how the signal changed while it was moving through the metal ingot. The difference in signals may be representative of a certain characteristic or set of characteristics associated with the ingot. This analysis may allow for a user to determine if an ingot was properly cast, or how formation of future ingots may be adjusted or improved (e.g., by adjusting the casting system or casting process associated with that ingot) in the future. The signal generator and/or signal receiver may be coupled to a casting apparatus, such as to a portion of the mold, or may be located elsewhere within the casting system.

As described herein with respect to the casting control device 210, data captured at sensors 208 may be stored at casting control device 210, which may be or which may incorporate devices or functionality similar to controller 410. Casting control device 210 or another device that receives data captured by sensors 208 may be configured to process that data to make determinations, calculations, or other decisions based on the received data. As described in more detail below, data captured by sensors 208 or 308 may include sounds, such as infrasounds or ultrasounds, other acoustics, or other data (collectively or individually may be referred to herein as sounds, sound signals, acoustic signals, signals, or the like) that are indicative of an event that takes place during casting of an ingot by the casting system during a casting operation.

Casting control device 210 may be located in a control room, such as control room 209 as shown in FIG. 2. However, casting control device 210 may also be physically part of the casting system (e.g., located on the casting apparatus) or may be located at a different location away from the casting system, and may communicate with the casting system wirelessly. Furthermore, use of the casting control device 210 may be initiated by a user, as shown in the control room 209, or may perform operations automatically based on software and/or algorithms programmed into the casting control device 210. In another example, casting control device 210 may be programmed to begin processing certain data when that data is received, or when a certain type of data is received.

After sensor data, such as sounds (e.g., infrasounds, ultrasounds), are captured by the one or more sensors in the casting system, and the sensor data is transmitted to one or more data storage devices and/or control devices, the sensor data may be treated in a variety of different ways. For example, the sensor data may be analyzed to determine characteristics of the sensor data and/or characteristics of the sounds represented by the sensor data. More specifically, sounds may be analyzed to determine characteristics such as frequency, pitch, loudness, decibel level, or tone, among others. Using the sensor data and characteristics of the sensor data, one or more profiles may be generated. The profiles may be associated with, for example, a type of event associated with a casting operation using the casting apparatus or other devices in the casting system. In other words, the profiles may correlate certain sounds or characteristics of those sounds, or both, to certain events associated with a casting operation or the casting system.

The profiles may include the identification of one or more ranges of sound characteristics (e.g., a range of frequencies) associated with the event that the profile is associated with. In another example, the profiles may identify patterns of characteristics of the captured sound data. The range or pattern may help the control device to identify when other sensor data, being compared to the profile, may be similar to the profile data. These characteristics, and any ranges or patterns associated with those characteristics, may be refined over time using machine learning. For example, the amount of sensor data may increase over time using aggregation of sensor data from multiple different casting operations, or multiple different casting systems. For example, even though one sound with particular sound characteristics (e.g., a certain frequency, tone, etc.) may occur during one casting operation, a similar but different sound may occur with slightly (or vastly) different characteristics. Outlier sensor data may be filtered out as anomalies, or may be included in the profile as well. Over time, the profiles associated with certain events may be adjusted and refined based on new sensor data. This refining may allow the sensor data to be used to more accurately predict future events, or characteristics of future events, and therefore allow a user to more accurately or effectively prepare for such events, or to prevent those events altogether. For example, if a certain sound occurs before or during every or almost every event of a certain type, a user may be able to predict, based on a notification from the control device, that the event will occur if the sound occurs. After a profile, casting operation, or casting system has been adjusted based on new sensor data, another casting operation may be initiated using the adjusted casting system and/or operation.

Furthermore, the casting system (e.g., control device or other device) may be programmed to automatically take action based on a determined likely event in the future. For example, instead of (or in addition to) notifying a user of a certain possible event and/or likelihood of the event, the system may automatically take a particular action that the system has been programmed to take when the event is identified or a certain threshold likelihood of the event occurs. For example, if a threshold is set by a user (or by a machine learning algorithm developed by the casting system, such as a control device) at 75% likelihood for a certain event, and the control system determines that the likelihood of the event occurring during a particular casting operation is 76%, then the control device may take action automatically to prevent the event from happening again, to prevent damage to one or more devices of the casting system or to prevent injury to a user, among other possible follow-up events.

Various different adjustments or changes may be made to the casting system or casting operations/process in response to detection of a particular event. For example, the casting system, or an individual apparatus within the casting system, may be shut down. In another example, a specific recipe for a specific casting operation may be adjusted. For example, the designated speed of the bottom block may be adjusted to move faster or slower (or to stop altogether) based on an event caused at least in part by the speed of the bottom block, or otherwise. In another example, the speed of molten metal flowing from the spout may be adjusted. The user, control device or other component of the system may be configured to adjust any aspect of the casting system, including individual devices in the system, or one or more casting operations/processes based on an event detected due to the analysis of sensor data.

In some embodiments, determining that a particular type of event has occurred may be necessarily deterministic, or may be less than one-hundred percent deterministic. For example, instead of definitively determining that an event occurred, the system may determine a recommendation as to what event or set of events may have occurred. The determination may include a calculated or approximate probability as to how likely it is that the event or events took place. A determination that the event took place may be the result of comparing the probability or likelihood to a threshold. The threshold may be predetermined, or may be determined by the system over time using machine learning, and may be updated over time when new sensor data is received, either from the same casting operation or additional casting operations.

Figure 5:
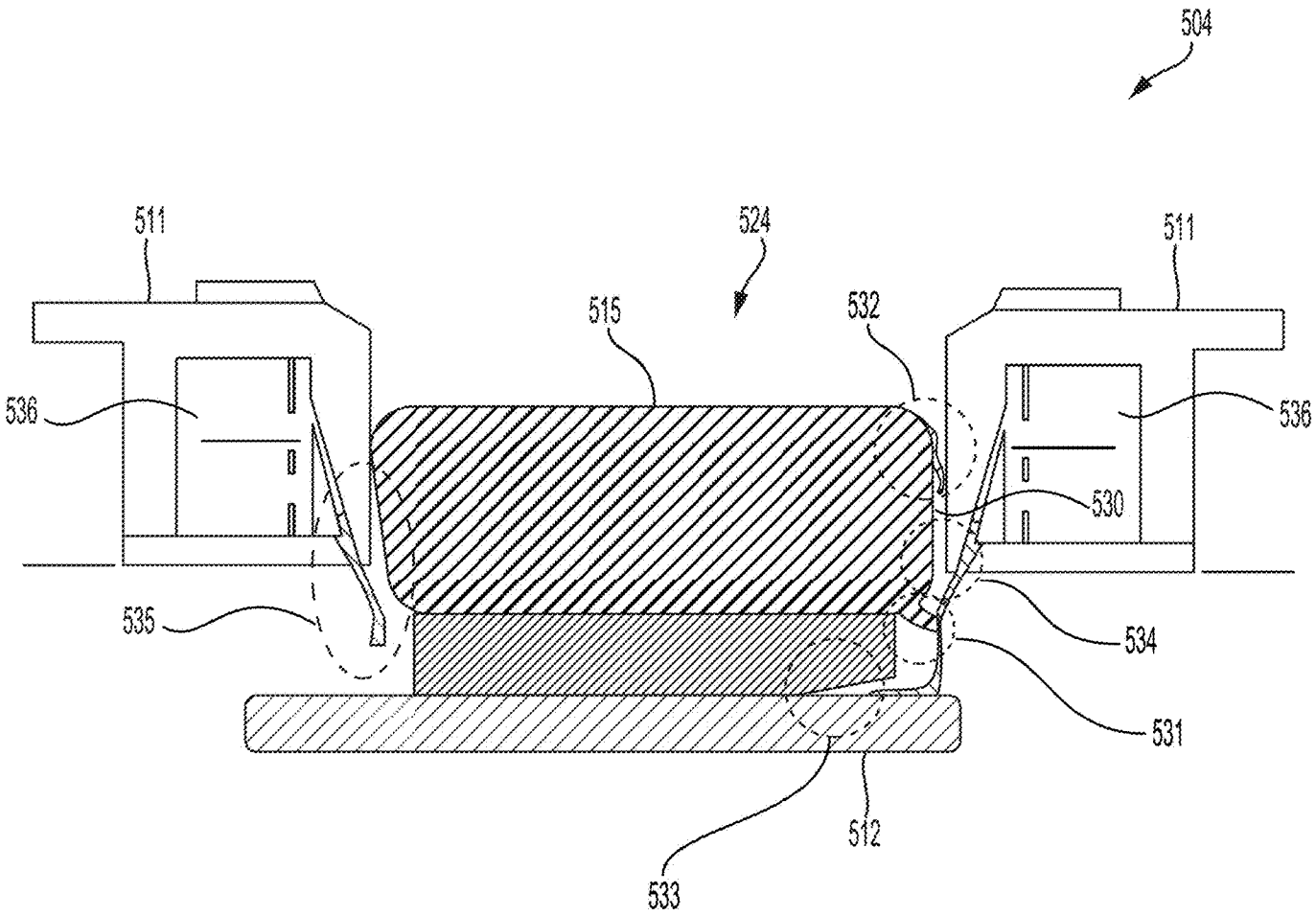
FIG. 5 is an example DC casting apparatus during a casting operation to form an ingot, according to embodiments of the present technology.

FIG. 5 is an example DC casting apparatus 504 during a casting operation to form an ingot, according to embodiments of the present technology. The ingot 515 (e.g., a partially formed ingot) being formed by the DC casting operation illustrated in FIG. 5 also illustrates events or the resulting structure associated with those events that may occur during a casting operation. As noted herein, many different types of events may occur during a process of casting of metal using a DC casting process in the DC casting system. For example, the events may include events that cause deforming of an ingot, or other types of errors. The casting event detection system described herein may detect one or more of these events by capturing one or more sounds associated with those events. The sounds may include infrasound, such as those with a frequency below 20 Hz. The sounds may also include ultrasounds, such as those with a frequency above 20,000 Hz. The sounds may also include audible sounds such as those with audible frequencies.

One example type of event that may be detected by sensors of the event detection system is a "bleed out," otherwise known to a person of ordinary skill in the art as a "yo-out." An example partially formed ingot with a bleed out is shown in, for example, portion 531 of FIG. 5. A bleed out may include any loss of molten metal through a rupture or tear in the ingot shell 530 (i.e., outer layer of the ingot) as the ingot is being formed. For example, melting or tearing of the ingot shell may cause a loss of molten metal out of the ingot sump (i.e., inner pool or inner trough 524 of the ingot while the ingot is being formed), such as the inner pool of molten metal within the mold. A bleed out may include a small stream of molten metal exiting the ingot sump, or may include a large amount of molten metal exiting the ingot sump, up to and including emptying of the molten metal from the sump. Such an emptying of the molten metal from the sump may be called a "yo out." A bleed out or yo out may cause an explosion or other reaction.

When a bleed out event takes place, the event may yield a distinct, high-frequency sound, such as a hissing-type sound. If the bleed out progresses to a yo out, the hissing sound may become deeper and lower in frequency. The event may also yield a loud thud-type sound. After a bleed out or yo out, the casting of metal process may stop, either manually by a user or automatically by the casting event detection system. To stop the casting process, a control pin (such as, for example, control pin 321 in FIG. 3) may drop to zero percent such that the opening in the bottom of the lower tip (e.g., lower tip 317 in FIG. 3) of the spout (e.g., spout 318 in FIG. 3) is closed. Other portions of the casting system may stop and/or shut off as well. After a bleed out or yo out, the casting system may not be able to complete the formation of the ingot, and the partially formed ingot may then be recycled. The bleed out or yo out may also cause the user to have to clean out the pit in which the mold is located and where the casting is taking place.

Figure 6:
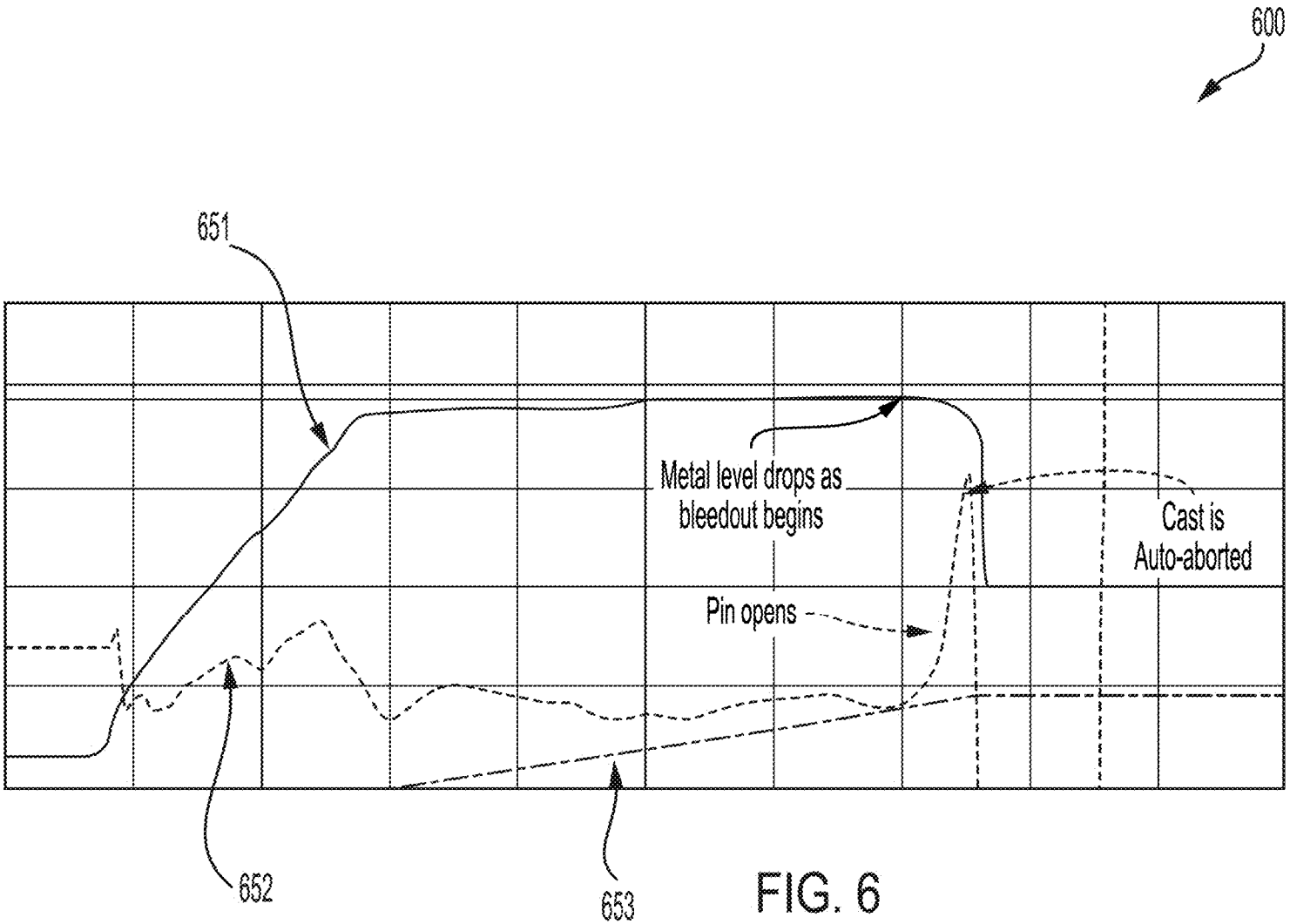
FIG. 6 is a line graph showing a time lapse of an example bleed out, according to example embodiments of the present technology.

FIG. 6 is a line graph 600 showing a time lapse of an example bleed out, according to example embodiments of the present technology. Graph 600 illustrates the progress of the metal level (line 651), percentage that the control pin (e.g., control pin 321 in FIG. 3) is open (line 652), and cast length (line 653) during the casting of molten metal during which a bleed out occurs. As illustrated by the line graph, after a bleed out occurs, the metal level in the mold drops, and the pin opens as a response to attempt to maintain a correct molten metal level in the mold. When the pin is open more than a certain threshold percentage for more than a certain threshold period of time (e.g., over 60% for more than five seconds), the casting process may be automatically aborted by a control device.

Another example type of event that may be detected by sensors of the event detection system is a "bleed over." An example partially formed ingot with a bleed over is shown in, for example, portion 532 of FIG. 5. A bleed over may include a flow of molten metal over the solidified metal on the ends of a forming or completely formed ingot. A bleed over may be caused by butt curl that leaves a gap between the forming, solidified ingot and the mold. A bleed over may also result in a bleed out. However, unlike in a bleed out, where molten metal may exit the ingot sump via a hole in the ingot shell, molten metal in a bleed over may flow over the top and down the sides of an ingot. Similar to after a bleed out, the casting process may stop. More specifically, the casting system may stop as a result of detecting the sounds associated with the bleed over. One of the resulting actions after an event such as a bleed over is detected is lowering the pins to attempt to stop the metal flow through the spout into the mold. If a bleed over (or a bleed out) heals, the metal level may rise again, and the casting process may continue. When a bleed over occurs, the bleed over may cause a distinctive sound that may start when the bleed over begins and may stop when the bleed over ends.

Another example type of event that may be detected by sensors of the event detection system is a "butt bounce." A butt bounce may occur when a release of energy or gas (e.g., an explosion) such as steam occurs in a gap between a block (such as bottom block 512 in FIG. 5) and the ingot being formed. Such a release of energy or gas may be due to a build-up of heat and/or steam in the gap, causing the steam to expand rapidly, which may pressurize and/or react with the solidified or molten metal in the gap. This type of explosion occurs when moisture is trapped under molten metal. The moisture superheats, then escapes the molten metal by throwing the molten metal. An explosion that causes a butt bounce may be called a steam explosion or a steam trap explosion. One or more explosions may cause the ingot to lift up from the block.

A steam explosion may occur during other events described herein, such as a bleed out or bleed over. Furthermore, a steam explosion may cause one or more additional explosions, such as an aluminum thermite reaction. An aluminum thermite reaction may occur due to a reaction between molten aluminum and a metal oxide such as iron oxide or copper oxide. Aluminum thermite reaction may occur between molten aluminum and rust (iron oxide). Rust could be present on a starting head or starting head base, and if a bleedout occurs due to a bad recipe, excessive curl, or butt bounce, a resulting explosion could be thermite rather than steam related. This result exemplifies the importance of listening for the bleed out early on and correcting through a system shut down. It may be important to detect a butt bounce so that users of the casting system may adjust one or more characteristics (e.g., casting parameters) of the casting process to avoid a butt bounce, or at least one or more explosions that cause a butt bounce. Listening to the intensity of the small steam explosions that occur during butt bounce may indicate the severity of the butt bounce occurrence, pushing an operator to certain casting parameter changes.

Butt bounce (and other events described herein) may be dangerous for users or may cause ingot loss due to a cracked or otherwise damaged ingot. A butt bounce, and the severity of the butt bounce, may be detected by receiving and analyzing certain sounds associated with a butt bounce. For example, the louder the explosions and butt bounce, the more severe they may be, and therefore the more dangerous and/or damaging they may be. When a butt bounce is detected, the casting process may stop, which may be caused by closing the pins (and possibly other steps, including one or more of tilting the furnace back, draining the launder, and stopping the platen). More specifically, the casting system may stop as a result of detecting the sounds associated with the butt bounce. In another example, causing an adjustment to the casting apparatus or to the casting operation may include generating a modified recipe for the casting operation. Modifying a recipe for the casting operation may be a result of any detected event described herein. In an alternative approach, sounds associated with an event may be detected, the sounds may be interpolated with the metal level system feedback, and parameters may be set up to cause the system shut down based on severity of both sound and metal level feedback. These parameters, feedback, and analysis will drive the recipe change for the next cast to reduce those severities.

Another example type of event that may be detected by sensors of the event detection system is "butt curl." An example partially formed ingot 515 with a result of butt curl is shown in, for example, portions 533 of FIG. 5. The butt of an ingot may be deformed by butt curl occurring during casting of an ingot. For example, this deformation may include an upward (the bottom of the ingot) or inward (the side of the ingot) curling of one or more ends of the ingot. When upward curling occurs, the ingot may curl up and away from the bottom block. Deformation may occur when liquid, such as water, contacts the ingot as it emerges from the mold. Rapid cooling caused by the cold liquid may cause rapid solidification and contraction around the periphery of the ingot. As noted herein, a butt bounce may occur when a release of energy or gas (e.g., an explosion) such as steam occurs in a gap between a block and the ingot being formed. However, deformation may also occur (in addition or instead) by a film boiling washing off one or more surfaces of the ingot. Butt curl may cause the ingot to "rock" back and forth since portions of the ends of the ingot may no longer be in contact with the bottom block after butt curl occurs. Butt curl may yield a specific sound that may be detected by the sensors in the casting apparatus, and detecting such an event may cause the system to shut down or be adjusted to avoid excessive butt curls in the next or other future casting operations.

In another example, sensors in the casting apparatus system may include video or other similar cameras to detect a certain type of event, such as butt curl, even if the audio sensor(s) do not detect a sound associated with the event. For example, if visual data (e.g., photograph, video, etc.) is captured, software may be used to perform recognition to identify objects or other aspects of the system in the collected data. For example, recognition may be used to identify butt curl in a photograph or a butt bounce in a video. Such video or other visual sensors may also be used to detect any of the other events described herein.

Another example type of event that may be detected by sensors of the event detection system is the opening of water jets or other events associated with water cooling of the ingot after water cooling has begun. An example partially formed ingot 515 with water cooling is shown in, for example, portions 534 and 535 of FIG. 5. Water (or other liquid) from jets may be used to cool molten metal during casting of an ingot. The mold of the casting system may include a pneumatic valve that may be actuated to allow the jets to turn on, allowing water or other liquid to flow through the jets. In certain embodiments, the pneumatic valve is used to enable/disable the dual jets, but not disable the single jet. One or more sets of jets may be used to cool an ingot during casting. For example, the jets may include a primary set of water jets and a secondary set of water jets. The two sets of jets may be in different locations or may be held at a different angles so that water from the two sets of jets contacts the ingot at different angles or at different portions of the ingot.

During cooling of an ingot, the casting system may yield a variety of different sounds associated with the jets and the cooling of the ingot. For example, a distinct sound may be generated by the actuation of the valve, by liquid beginning to flow out of the jets, by liquid contacting the ingot when the ingot or portions of the ingot are at different temperatures, among other events. Furthermore, the different sets of jets may yield slightly different sounds due to their different location, different angle, or for other reasons. In another example, two or more different sets of jets may turn on, and therefore begin water flow, at different times. Therefore, the two or more different sets of jets may yield sounds associated with those events at different times. In another example, the sounds associated with a set of jets may change if one or more of the jets fails and ceases water flow. Such sounds may indicate that the jet has failed, and may initiate a user to fix the jet during or after a casting process. Sounds yielded by the water jets may also change based on how fast the ingot (as caused by movement of the bottom block) is moving through the casting system. For example, the faster the ingot moves, the more heat the system may generate, and the more water needed to cool the ingot and/or the colder the water may be to cool the ingot.

Another example type of event that may be detected by sensors of the event detection system is air being located within a mold during a casting process. For example, air may be located within region(s) 536 of the mold 511. Before and during cooling of an ingot during casting of the ingot, a portion of the mold (e.g., region(s) 536) may be partially or fully filled with water so that water flow out of the jets is consistent and yields a consistent cooling of the ingot. One or more events may occur if the mold is not filled with water, and instead air fills a portion of the mold. The flow of air or the flow of a combination of water and air may yield distinct sounds that may be captured by sensors. For example, such a sound may be similar to water flowing out of a garden hose when the water flow is turned on, since air may be located in the hose until water flows through it.

Figure 7:
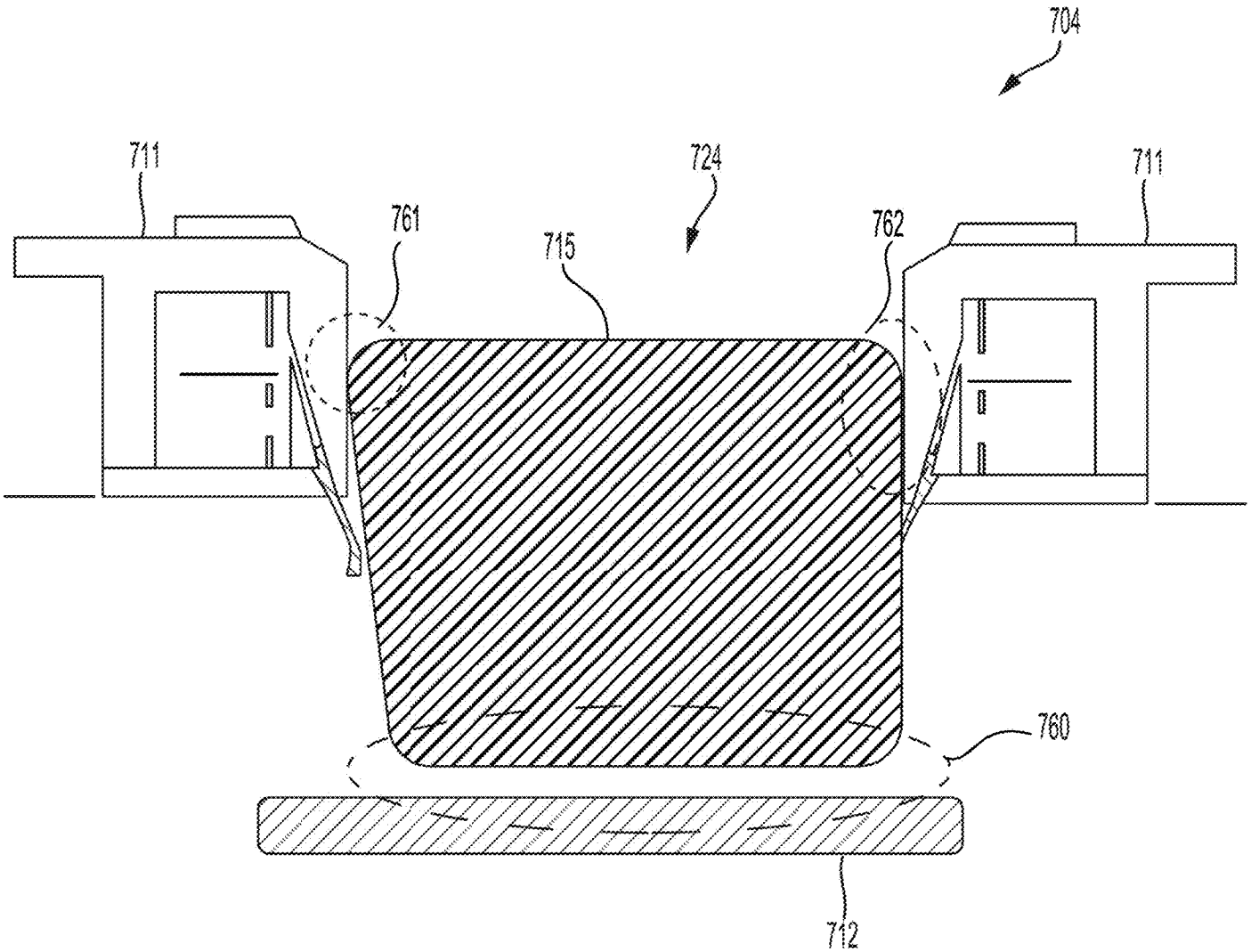
FIG. 7 is an example DC casting apparatus during a casting operation to form an ingot, according to embodiments of the present technology.

FIG. 7 is an example DC casting apparatus 704 during a casting operation to form an ingot, according to embodiments of the present technology. Another example type of event is a "hang up" or a "hang up drop." An example partially formed ingot with a hang up is shown in, for example, portion 760 of FIG. 7. While an ingot 715 is formed on top of a bottom block 712, the bottom block 712 may move with the ingot 715 while the ingot 715 moves downward through the mold 711 while the ingot 715 is being formed. A hang up may occur when a partially-formed ingot 715 sticks to the mold 711, for example at mold/ingot contact points 761 and 762, causing the ingot to "hold up" and separate from the bottom block. In other words, since the ingot 715 stops moving when it hangs up but the bottom block 712 does not stop moving (because the bottom block 712 is not in contact with the mold 711), the bottom block 712 separates from the bottom of ingot 715. A hang up may yield a specific sound that may be detected by the sensors in the casting apparatus, and detecting such an event may cause the system to shut down or be adjusted to avoid hang ups in the next or other future casting operations. Other types of sensors may also detect a hang up using different types of data. For example, a temperature sensor may detect that the temperature near the bottom block 712 or the bottom of the ingot 715 has changed, such as because air flow between the ingot 715 and bottom block 712 has increased due to the space in between the two objects. In another example, a video or picture sensor may detect separation between the ingot 715 and the bottom block 712 by capturing video or photograph data (after being analyzed by the sensor or by another device, such as a control device).

Since the bottom block may be a significant source of cooling for the ingot, the ingot may retain substantial heat after it separates from the bottom block, and the ingot may deform. For example, a hole may generate in the bottom of the ingot, causing a bleed out (i.e. molten metal to flow out of the bottom of the ingot through the hole). In certain embodiments, as the bottom block is a controlled heat extraction system for the solidifying ingot, the ingot will both retain heat, as well as re-heat during solidification and deformation (e.g., butt curl). For example, as the ingot pulls away from the starting head, the solidified material is now absent of any cooling, while new molten metal is still be introduced above into the sump of the ingot. Reheating can take place, where molten material can burn through the solidified ingot butt and spill out onto both the starting head and the casting system. This event may be heard as a bleed out. The starting head contains cooling water, and molten metal would be introduced into this water with the potential for an explosion.

A hang up drop may occur when the ingot 715, after a hang up, releases from sticking to the mold 711, and drops to re-contact the bottom block 712 and/or liquid (e.g., hot water, molten metal, or other liquid) that has accumulated on the bottom block 712 at the bottom of the mold. A hang up drop may also cause an explosion when the ingot 715 contacts liquid at the bottom of the mold 711 (e.g., on bottom block 712 or otherwise). A hang up drop may yield distinct sounds, including sounds associated with the ingot 715 re-contacting the block and/or liquid at the bottom of the mold 711, or from a splash of the liquid after the ingot 715 contacts the liquid. These events may yield other sounds, including sounds from the ingot 715 deforming or cracking. A hang up release may occur when enough weight pushes the ingot back onto the starting head. Furthermore, the hang up along with the introduction of molten metal due to the extreme metal level shift at hang up release, many sounds may be heard. For example, sounds may be heard related to the ingot re-contacting the starting head, bleed out sounds, water splashing out of the starting head as the ingot displaces it, and an explosion.

Another example type of event that may be detected by sensors of the event detection system may include damaging or breaking of a degassing hood of the casting system. A degassing hood may be placed on either the trough, or degassing unit, which allows the rotors to enter the molten metal. Rotors (e.g., graphite rotors) on the degassing hood may purge argon and chlorine into the molten metal to remove trace elements of contaminants that are not wanted in the molten metal, such as hydrogen. However, if the rotors get filled with solidified metal from the molten metal, the rotors may break, and may no longer be able to clean the metal. A lack of degassing (e.g., due to a broken or plugged rotor) may cause a user to stop the casting process until the rotors can be cleaned or replaced. The degassing hood may yield distinct sounds, such as sounds associated with broken rotors, among others.

Figure 8B:
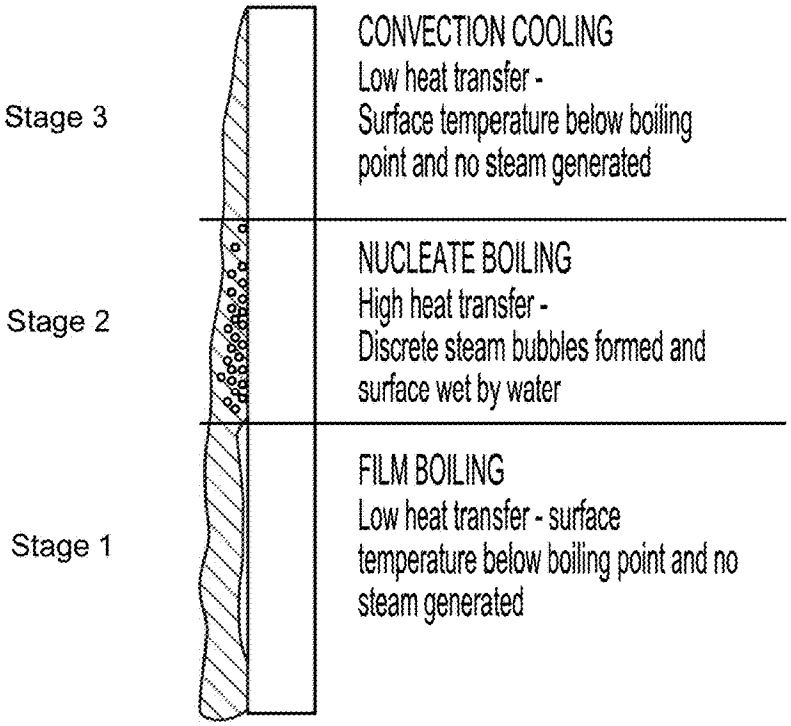
FIG. 8B is a graphic that illustrates the stages of a convection process during casting of an ingot, according to embodiments of the present technology.
Figure 8A:
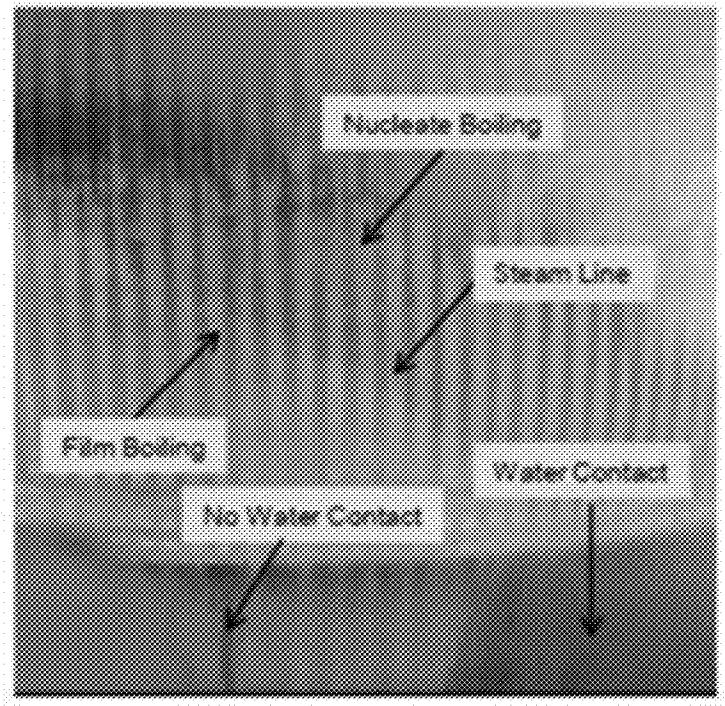
FIG. 8A is a picture of an example ingot experiencing film boiling and nucleate boiling, according to embodiments of the present technology.

FIG. 8A illustrates a picture of an example ingot experiencing film boiling and nucleate boiling, according to embodiments of the present technology. Another example type of event that may be detected by sensors of the event detection system is a "film establishment," "film boiling," or "complete film wash off." During formation of an ingot, while molten metal is being fed into the ingot sump, a process of liquid or water cooling may be used to cool the ingot as it is being formed. This process may include cold liquid (e.g., water) being sprayed onto the outside of the ingot to cool the molten metal so that the molten metal solidifies into solidified metal as part of the ingot. Film boiling may occur when the temperature of the surface being cooled (e.g., the ingot) is higher than the boiling point of the liquid being sprayed on the surface. In such a situation, the liquid may vaporize, forming a continuous film or layer of steam on the surface. The layer of steam may prevent the liquid that is later sprayed on the surface from directly contacting the surface after the film is formed.

Film boiling may be used on purpose towards the beginning of a casting process to prevent deformation of the ingot due to other events, such as excessive curl (e.g., butt curl), occurring. For example, film boiling may slow the rate of heat extraction from the ingot while the liquid is being sprayed on the ingot, and may give the user more control over the casting process and possible events during casting. When film boiling takes place, the film boiling may cause a distinctive sound, such as a sizzling-type sound (similar to, for example, when cold water contacts a hot surface, such as a frying pan).

Figure 8C:
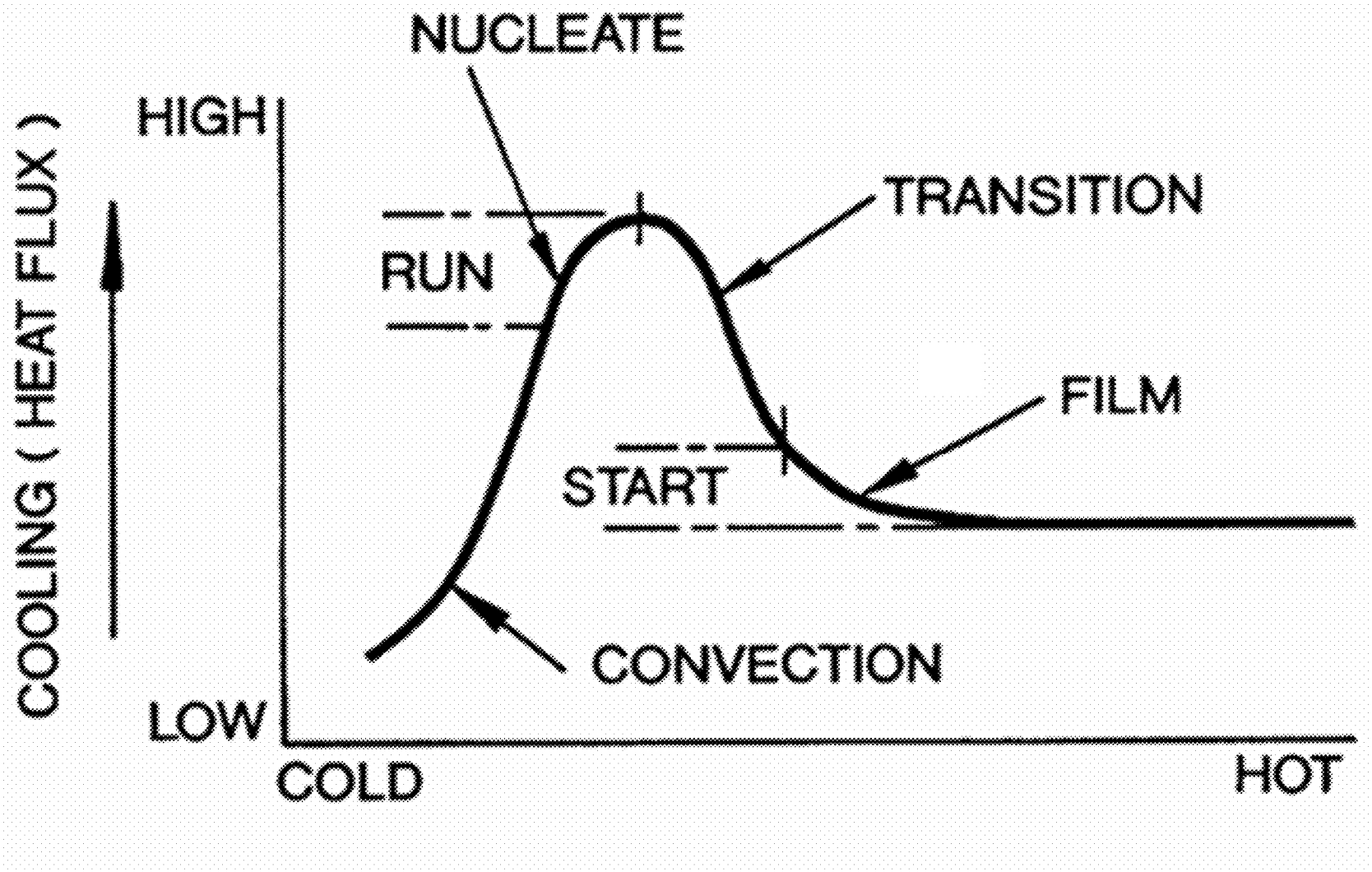
FIG. 8C is a graph that illustrates the stages of a convection process during casting of an ingot, according to embodiments of the present technology.

FIG. 8B is a graphic that illustrates the stages of a convection process during casting of an ingot, according to embodiments of the present technology. FIG. 8C is a graph that illustrates the stages of a convection process during casting of an ingot, according to embodiments of the present technology. As shown in FIGS. 8B and 8C, film boiling may be only a first stage of a convection process used during a casting process, and film boiling may take place at 350-450*c*. For example, while film boiling may be used during a first portion of a casting process (e.g., for the first twelve inches of ingot being formed), nucleate boiling may be used during other portions of the casting process. Nucleate boiling may cause a higher transfer of heat from the surface of the forming ingot than film boiling. For example, nucleate boiling may cause discrete steam bubbles to form, allowing the liquid to more directly contact the surface of the ingot to cool it down more quickly. In contrast, during film boiling, the temperature at the surface of the ingot may be so hot that liquid water cannot touch the surface. When transitioning between film boiling and nucleate boiling, film may begin to wash down the side surface of the ingot. Once the process has transitioned to nucleate boiling, the ingot may experience "complete film wash off," which may occur at, for example, approximately 250c. Furthermore, when nucleate boiling takes place (e.g., at below 250c), nucleate boiling may cause another distinctive sound, different from the sound yielded by film boiling.

Other events not described herein that occur during casting may also be detected by sensors of the event detection system.

Figure 9:
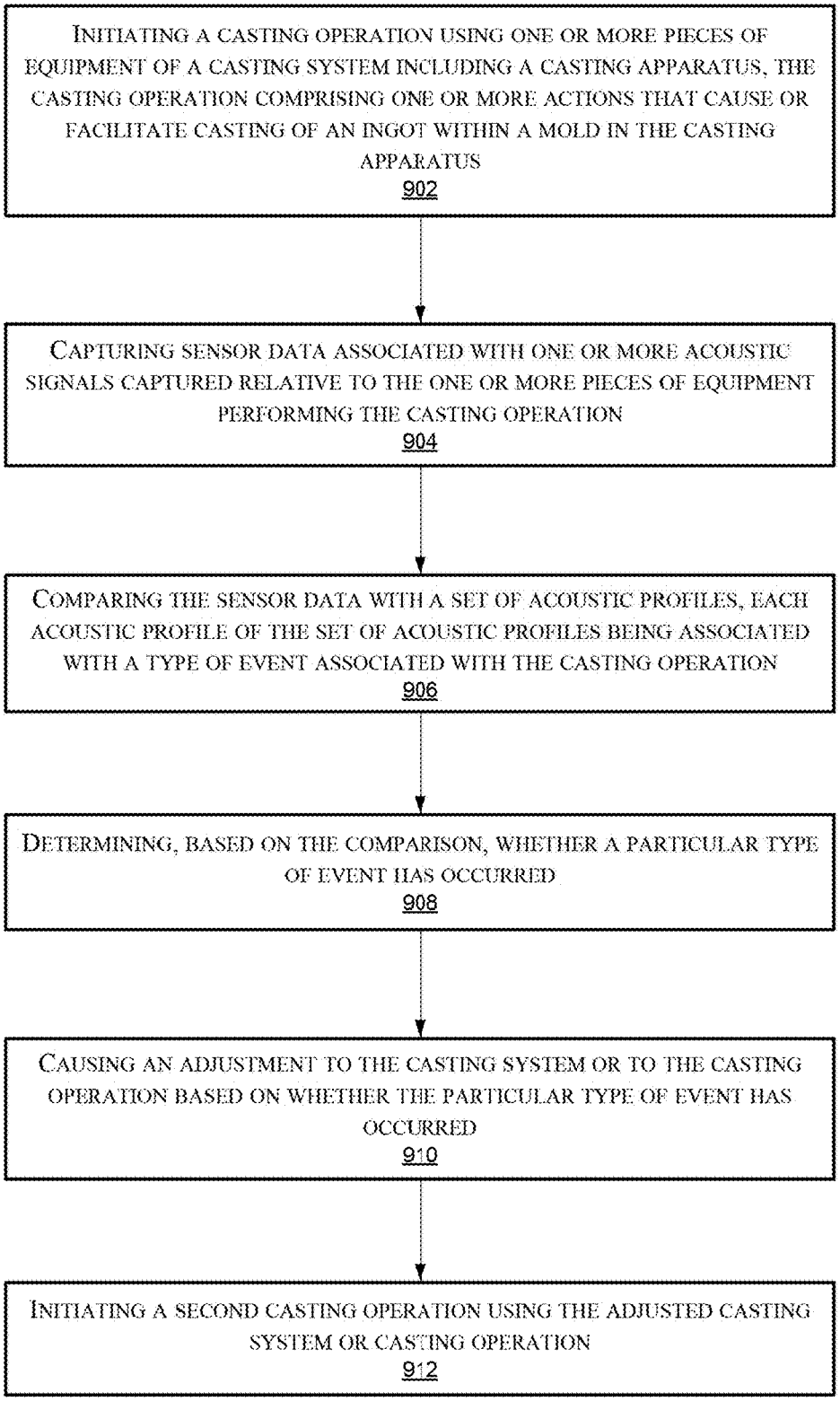
FIG. 9 is an example flow diagram of an example process according to embodiments of the present technology.

FIG. 9 is an example flow diagram of an example process according to embodiments of the present technology. Step 902 may include, for example, initiating a casting operation using one or more pieces of equipment of a casting system including a casting apparatus, the casting operation comprising one or more actions that cause or facilitate casting of an ingot within a mold in the casting apparatus. The casting operation may include, for example, a process to cast an ingot using molten metal. Step 904 may include, for example, capturing, using an acoustic sensor, sensor data associated with one or more acoustic signals captured relative to the one or more pieces of equipment performing the casting operation. Other sensors may also be used other than acoustic sensors, and those additional sensors may capture different types of data other than sound data. The data may be captured, stored, and analyzed in the event detection system, and the result of that analysis may be used for later steps in this process. Step 906 may include, for example, comparing the sensor data with a set of acoustic profiles, each acoustic profile of the set of acoustic profiles being associated with a type of event associated with the casting operation. The acoustic profiles may each be associated with a different type of event, as described herein. Profiles may also be adjusted over time using additional data collected from additional casting operations. Profiles and other casting data collected, analyzed, and generated by the system may be shared across casting systems to help compile more accurate data and analysis for casting systems. Step 908 may include, for example, determining, based on the comparison, whether a particular type of event has occurred. More specifically, data collected and/or analyzed from the sensors may be compared to the generated or received profiles. For example, if data collected at sensors match (e.g., over a certain threshold amount or within a certain range) a profile, then it may be determined that the event took place. Step 910 may include, for example, causing an adjustment to the casting system or to the casting operation based on whether the particular type of event has occurred. The adjustment may include shutting down the casting operation, or a less drastic change to the system, such as changing a certain characteristic. Instead of changing the system itself, changes to the process (e.g., recipe) for the operation may also be changed. And step 912 may include, for example, initiating a second casting operation using the adjusted casting system or casting operation.

The above-described aspects are merely possible examples of implementations, merely set forth for a clear understanding of the principles of the present disclosure. Many variations and modifications can be made to the above-described example(s) without departing substantially from the spirit and principles of the present disclosure. All such modifications and variations are included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

A collection of exemplary examples, including at least some explicitly enumerated as "ECs" (Example Combinations), providing additional description of a variety of example types in accordance with the concepts described herein are provided below. These examples are not meant to be mutually exclusive, exhaustive, or restrictive; and the invention is not limited to these example examples but rather encompasses all possible modifications and variations within the scope of the issued claims and their equivalents.

Aspect 1 is an apparatus for detecting events during a casting operation, the apparatus comprising: a mold; a conduit configured to deliver molten metal to the mold for casting the molten metal into an ingot; a sensor configured to sense acoustic signals from the casting operation, wherein the sensor captures sensor data associated with the casting operation; a controller comprising a processor configured to execute instructions stored on a non-transitory computer-readable medium in a memory, the controller causing the processor to perform processor operations including: comparing the sensor data with a set of acoustic profiles; determining, based on the comparison, whether a particular type of event has occurred; causing an adjustment to the apparatus or to the casting operation based on whether the particular type of event has occurred; and initiating a second casting operation using the adjusted casting system or casting operation.

Aspect 2 is the apparatus of aspect(s) 1 (or of any other preceding or subsequent aspects individually or in combination), wherein the sensor comprises an acoustic sensor and the acoustic sensor is configured to capture initial sensor data associated with acoustic signals from multiple casting operations over an initial period of time, and wherein the processor operations further include: generating, using the initial acoustic signals, the set of acoustic profiles, each acoustic profile of the set of acoustic profiles being associated with a type of event associated with the multiple casting operations over the initial period of time.

Aspect 3 is the apparatus of aspect(s) 2 (or of any other preceding or subsequent aspects individually or in combination), wherein the processor operations further include: updating the set of acoustic profiles using the sensor data and the determination of whether a particular type of event has occurred.

Aspect 4 is the apparatus of aspect(s) 2 (or of any other preceding or subsequent aspects individually or in combination), wherein comparing the sensor data with the set of acoustic profiles includes comparing characteristics of the acoustic signals captured relative to the casting operation to characteristics of acoustic signals captured during previous casting operations.

Aspect 5 is the apparatus of aspect(s) 4 (or of any other preceding or subsequent aspects individually or in combination), wherein the characteristics of the acoustic signals include one or more of frequency, pitch, loudness, or tone.

Aspect 6 is the apparatus of aspect(s) 2 (or of any other preceding or subsequent aspects individually or in combination), wherein an acoustic profile of the set of acoustic profiles includes a machine learning algorithm generated using data associated with multiple instances of a particular event associated with one or more casting systems.

Aspect 7 is the apparatus of aspect(s) 1 (or of any other preceding or subsequent aspects individually or in combination), wherein determining whether a particular type of event has occurred includes determining a recommendation regarding whether the particular type of event has occurred and a likelihood that the particular type of event has occurred based on the sensor data.

Aspect 8 is the apparatus of aspect(s) 1 (or of any other preceding or subsequent aspects individually or in combination), wherein causing an adjustment to the casting apparatus or to the casting operation includes shutting off the casting apparatus or generating a modified recipe for the casting operation.

Aspect 9 is the apparatus of aspect(s) 1 (or of any other preceding or subsequent aspects individually or in combination), wherein the particular type of event includes one or more of a bleed out, a bleed over, a butt bounce, butt curl, or a water cooling operation.

Aspect 10 is the apparatus of aspect(s) 1 (or of any other preceding or subsequent aspects individually or in combination), further comprising a melting furnace, a holding furnace and a degasser.

Aspect 11 is a system for detecting events during a casting operation, the system comprising: the casting apparatus of aspect(s) 1; and one or more pieces of equipment of a casting system.

Aspect 12 is a method of detecting events in casting of metal, the method comprising: initiating a casting operation using one or more pieces of equipment of a casting system including a casting apparatus, the casting operation comprising one or more actions that cause or facilitate casting of an ingot within a mold in the casting apparatus; capturing, using an acoustic sensor, sensor data associated with one or more acoustic signals captured relative to the one or more pieces of equipment performing the casting operation; comparing the sensor data with a set of acoustic profiles, each acoustic profile of the set of acoustic profiles being associated with a type of event associated with the casting operation; determining, based on the comparison, whether a particular type of event has occurred; causing an adjustment to the casting system or to the casting operation based on whether the particular type of event has occurred; and initiating a second casting operation using the adjusted casting system or casting operation.

Aspect 13 is the method of aspect(s) 12 (or of any other preceding or subsequent aspects individually or in combination), further comprising: capturing, using an initial acoustic sensor, sensor data from multiple casting operations using one or more initial casting apparatuses over a period of time; and generating, using the sensor data, the set of acoustic profiles.

Aspect 14 is the method of aspect(s) 13 (or of any other preceding or subsequent aspects individually or in combination), wherein the one or more initial casting apparatuses include the casting apparatus.

Aspect 15 is the method of aspect(s) 12 (or of any other preceding or subsequent aspects individually or in combination), further comprising: updating the set of acoustic profiles using the sensor data and the determination of whether a particular type of event has occurred.

Aspect 16 is the method of aspect(s) 12 (or of any other preceding or subsequent aspects individually or in combination), wherein comparing the sensor data with the set of acoustic profiles includes comparing characteristics of the acoustic signals captured relative to the one or more pieces of equipment performing the casting operation to characteristics of acoustic signals captured during previous casting operations.

Aspect 17 is the method of aspect(s) 16 (or of any other preceding or subsequent aspects individually or in combination), wherein the characteristics of the acoustic signals include one or more of frequency, pitch, loudness, or tone.

Aspect 18 is the method of aspect(s) 12 (or of any other preceding or subsequent aspects individually or in combination), wherein an acoustic profile of the set of acoustic profiles includes a machine learning algorithm generated using data associated with multiple instances of a particular event associated with one or more casting systems.

Aspect 19 is the method of aspect(s) 12 (or of any other preceding or subsequent aspects individually or in combination), wherein determining whether a particular type of event has occurred includes determining a recommendation regarding whether the particular type of event has occurred and a likelihood that the particular type of event has occurred based on the sensor data.

Aspect 20 is the method of aspect(s) 12 (or of any other preceding or subsequent aspects individually or in combination), wherein causing an adjustment to the casting system or to the casting operation includes generating a modified recipe for the casting operation.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

That which is claimed is:

1. A non-transitory computer readable medium comprising program code, which when executed by a processor, is configured to cause the processor to:

receive sensor data from a sensor;

compare the sensor data with a set of acoustic profiles;

determine, based on the comparison, whether a particular type of event has occurred;

determine an adjustment to a casting system or a casting operation based on whether the particular type of event has occurred; and generate a control response for causing the adjustment to the casting system or the casting operation.

2. The non-transitory computer readable medium of claim 1, wherein the program code, which when executed by a processor is configured to further generate, using initial acoustic signals, the set of acoustic profiles, each acoustic profile of the set of acoustic profiles being associated with a type of event associated with multiple casting operations over the initial period of time.

3. The non-transitory computer readable medium of claim 1, wherein the program code, which when executed by a processor is configured to further update the set of acoustic profiles using the sensor data and the determination of whether the particular type of event has occurred.

4. The non-transitory computer readable medium of claim 1, wherein the program code, which when executed by a processor is configured to further compare characteristics of acoustic signals captured relative to a casting operation to characteristics of acoustic signals captured during previous casting operations.

5. The non-transitory computer readable medium of claim 1, wherein characteristics of the acoustic signals include one or more of frequency, pitch, loudness, or tone.

6. The non-transitory computer readable medium of claim 1, wherein the program code, which when executed by a processor is configured to further determine a recommendation regarding whether the particular type of event has occurred and a likelihood that the particular type of event has occurred based on the sensor data.

7. The non-transitory computer readable medium of claim 1, wherein the program code, which when executed by a processor is configured to further cause shutting off the casting system or generating a modified recipe for the casting operation.

8. The non-transitory computer readable medium of claim 1, wherein the particular type of event includes one or more of a bleed out, a bleed over, a butt bounce, butt curl, or a water cooling operation.

9. A system for detecting events during a casting operation, the system comprising:

at least one processor; and at least one sensor configured to sense acoustic signals from a casting operation, wherein the at least one sensor captures sensor data associated with the casting operation, wherein the at least one sensor is operably connected to the at least one processor, and wherein the at least one processor is configured to:

compare the sensor data with a set of acoustic profiles;

determine, based on the comparison, whether a particular type of event has occurred;

determine an adjustment to a casting apparatus or to the casting operation based on whether the particular type of event has occurred; and generate a control response for implementing the adjustment.

10. The system of claim 9, wherein the at least one sensor comprises an acoustic sensor and the acoustic sensor is configured to capture initial sensor data associated with acoustic signals from multiple casting operations over an initial period of time, and wherein the at least one processor is further configured to:

generate, using the initial acoustic signals, the set of acoustic profiles, each acoustic profile of the set of acoustic profiles being associated with a type of event associated with the multiple casting operations over the initial period of time.

11. The system of claim 9, wherein the at least one processor is further configured to update the set of acoustic profiles using the sensor data and the determination of whether the particular type of event has occurred.

12. The system of claim 9, wherein the characteristics of the acoustic signals include one or more of frequency, pitch, loudness, or tone.

13. The system of claim 9, wherein the at least one processor is further configured to determine a recommendation regarding whether the particular type of event has occurred and a likelihood that the particular type of event has occurred based on the sensor data.

14. The system of claim 9, wherein the particular type of event includes one or more of a bleed out, a bleed over, a butt bounce, butt curl, or a water cooling operation.

15. The system of claim 9, further comprising a melting furnace, a holding furnace and a degasser.

16. The system of claim 9, further comprising one or more pieces of equipment of a casting system.

* * * * *